US007352846B2

(12) United States Patent
Kuribayashi et al.

(10) Patent No.: US 7,352,846 B2
(45) Date of Patent: Apr. 1, 2008

(54) FILAMENT FOR X-RAY TUBE AND X-RAY TUBE HAVING THE SAME

(75) Inventors: Masaru Kuribayashi, Akishima (JP); Masahiro Nonoguchi, Tachikawa (JP); Naohisa Osaka, Ome (JP); Yoji Kobayashi, Akiruno (JP)

(73) Assignee: Rigaku Corporation, Tokyo (JP)

( * ) Notice: Subject to any disclaimer, the term of this patent is extended or adjusted under 35 U.S.C. 154(b) by 0 days.

(21) Appl. No.: 11/583,448

(22) Filed: Oct. 19, 2006

(65) Prior Publication Data

US 2007/0092064 A1 Apr. 26, 2007

(30) Foreign Application Priority Data

Oct. 21, 2005 (JP) ..... 2005-306553
Oct. 21, 2005 (JP) ..... 2005-306559

(51) Int. Cl.
*H01J 35/06* (2006.01)
*H01J 35/22* (2006.01)
*A47B 77/10* (2006.01)

(52) U.S. Cl. ..... 378/136; 378/121; 313/344

(58) Field of Classification Search ..... 378/119, 378/121, 136; 313/341–345
See application file for complete search history.

(56) References Cited

U.S. PATENT DOCUMENTS 3,631,289 A * 12/1971 Perry et al. ..... 378/136
3,885,179 A 5/1975 Friedel
6,333,969 B1 12/2001 Kujirai
6,356,619 B1 * 3/2002 Nagy et al. ..... 378/138
2005/0232396 A1 * 10/2005 Chidester ..... 378/136
2006/0233308 A1 10/2006 Noguchi et al.
2007/0090744 A1 4/2007 Kuribayashi

FOREIGN PATENT DOCUMENTS

JP 58-026144 B2 6/1983
JP 63-232264 A 9/1988
JP 1-161547 U 11/1989
JP 05-242842 A 9/1993
JP 6-9047 U 2/1994
JP 10334839 A * 12/1998
JP 2001-297725 A 10/2001

* cited by examiner

*Primary Examiner*—Edward J. Glick
*Assistant Examiner*—Irakli Kiknadze
(74) *Attorney, Agent, or Firm*—Frishauf, Holtz, Goodman & Chick, P.C.

(57) ABSTRACT

A coiled filament for an X-ray tube has a varied coil pitch to obtain a good uniformity of the longitudinal temperature distribution. The filament has a central region including plural turns having a same coil pitch, and end regions which include plural turns each of which has a coil pitch smaller than the coil pitch of the central region. The coil pitches of the plural turns of the end regions are reduced one by one by a same variation from a turn close to the central region toward an outermost turn. A value of Δp/p is within a range of 0.015 to 0.1 and k/n is within a range of 0.3 to 0.8, where p is the coil pitch of the central region, Δp is the coil pitch variation of the end regions, n is a total number of turns of the filament, and k is a sum of numbers of turns of the end regions. The k/n preferably satisfies the following equation:

$$k/n=0.72-4.66(\Delta p/p)\pm 0.12.$$

11 Claims, 18 Drawing Sheets

FIG. 4

| Coil specification | | | | Analytical result for varied pitch winding | | | $\frac{\Delta p}{p}$ | $\frac{k}{n}$ |
|---|---|---|---|---|---|---|---|---|
| d(mm) | D(mm) | n | p(mm) | Δp(μm) | i+j = k | Avg | | |
| 0.2 | 1.13 | 20 | 0.65 | 20 | 8～10 | 9 | 0.031 | 0.45 |
| | | | | 30 | 6～8 | 7 | 0.046 | 0.35 |
| | | | | 50 | 8～10 | 9 | 0.077 | 0.45 |
| 0.2 | 3 | 20 | 0.3 | 5 | 14～16 | 15 | 0.017 | 0.75 |
| | | | | 10 | 10～12 | 11 | 0.033 | 0.55 |
| | | | | 20 | 6 | 6 | 0.067 | 0.30 |
| 0.3 | 1.2 | 20 | 0.65 | 15 | 8～12 | 10 | 0.023 | 0.50 |
| | | | | 20 | 8～12 | 10 | 0.031 | 0.50 |
| | | | | 30 | 8～12 | 10 | 0.046 | 0.50 |
| | | | | 50 | 6～8 | 7 | 0.077 | 0.35 |
| 0.3 | 1.2 | 21 | 0.5 | 15 | 8～12 | 10 | 0.030 | 0.48 |
| | | | | 20 | 10～12 | 11 | 0.040 | 0.52 |
| | | | | 30 | 6～8 | 9 | 0.060 | 0.43 |
| | | | | 40 | 6～8 | 7 | 0.080 | 0.33 |
| 0.3 | 2.4 | 20 | 0.5 | 15 | 10～12 | 11 | 0.030 | 0.55 |
| | | | | 20 | 10～12 | 11 | 0.040 | 0.55 |
| | | | | 30 | 10～12 | 11 | 0.060 | 0.55 |
| | | | | 50 | 6 | 6 | 0.100 | 0.30 |
| 0.3 | 3 | 20 | 0.65 | 15 | 12～14 | 13 | 0.023 | 0.65 |
| | | | | 20 | 12～14 | 13 | 0.031 | 0.65 |
| | | | | 30 | 10～12 | 11 | 0.046 | 0.55 |
| | | | | 50 | 8～10 | 9 | 0.077 | 0.45 |
| 0.4 | 2.4 | 17 | 0.65 | 30 | 8～10 | 9 | 0.046 | 0.53 |
| | | | | 40 | 6～8 | 7 | 0.062 | 0.41 |
| | | | | 50 | 8 | 8 | 0.077 | 0.47 |
| 0.4 | 3 | 20 | 0.65 | 10 | 15 | 15 | 0.015 | 0.75 |
| | | | | 15 | 13 | 13 | 0.023 | 0.65 |
| | | | | 20 | 13 | 13 | 0.031 | 0.65 |
| | | | | 30 | 11～13 | 12 | 0.046 | 0.60 |

FILAMENT FOR X-RAY TUBE AND X-RAY TUBE HAVING THE SAME

BACKGROUND OF THE INVENTION

1. Field of the Invention

The present invention relates to a filament for an X-ray tube, and more specifically to a coiled filament with an improvement in temperature distribution uniformity along the longitudinal direction of the filament. The present invention also relates an X-ray tube having such a filament. The present invention further also relates to an X-ray tube with an improvement for a longer lifetime of the filament.

2. Description of the Related Art

A coiled filament for an X-ray tube preferably gives itself a uniform temperature distribution as far as possible over the whole length of the filament. The ordinary coiled filament for an X-ray tube has a constant wire diameter and a constant coil pitch, and therefore its temperature becomes highest at the longitudinal center and drops in the vicinity of the both ends. If the temperature distribution of the filament is uniform, the intensity distribution of an electron beam emitted from the filament becomes uniform, so that the brightness distribution of an X-ray focus becomes uniform, the X-ray focus being made by the electron bombardment on the target (i.e., the anode) of an X-ray tube. In addition, if the temperature distribution of the filament is uniform, the amount of wire diameter wear of the coil becomes uniform as compared with a filament which is not uniform in temperature distribution, so that the lifetime is prolonged. Furthermore, if the temperature distribution of the coil is uniform, the maximum temperature of the filament can be lowered for obtaining the same X-ray tube current as compared with the filament which is not uniform in temperature distribution, so that the lifetime is prolonged as well.

While the present invention is concerned with a varied coil pitch of the filament for an X-ray tube, the prior art most relevant thereto is disclosed in Japanese Utility Model Publication No. 6-9047 U (1994), which will be referred to as the first publication.

The first publication discloses that a filament for an X-ray tube has a particular coil pitch which is dense in the vicinity of the center and sparse in the vicinity of the both ends, so that the temperature in the vicinity of the center of the filament rises to make the electron density distribution Gaussian. It is considered accordingly that the prior art filament does not make the temperature distribution uniform but rather makes the temperature in the vicinity of the center higher than the ordinary coil having a constant coil pitch. The coiled filament of the first publication is 80 turns per inch in coil pitch in the vicinity of the center and 50 turns per inch in the vicinity of the both ends for example.

On the other hand, in the technical field other than the X-ray tube, a coiled filament having a particular coil pitch which is sparse in the vicinity of the center and dense in the vicinity of the both ends so as to obtain a uniform longitudinal temperature distribution is known and disclosed in, for example, Japanese Patent Publication No. 63-232264 A (1988), which will be referred to as the second publication, and Japanese Utility Model Publication No. 1-161547 U (1989), which will be referred to as the third publication.

The second publication relates to a coiled filament of a halogen lamp for a copying machine and discloses a coiled filament having a particular coil pitch which is denser at the both ends than the central region so as to prevent temperature drop at the ends to make the luminance at the ends the same as the central region. For example, the coil pitch is 26.3 turns per centimeter at the central region and 33.8 turns per centimeter at the ends.

The third publication relates to a coiled filament for a lamp for use in such as a vehicle and discloses a coiled filament having a particular coil pitch which is sparser at the central region than the both ends so as to obtain a uniform longitudinal temperature distribution. The third publication also discloses that the coil pitch of the outermost turn is set to be densest and the coil pitch is expanded one by one from the outermost end toward the central region.

It would be understood from the second and third publications that if the coil pitch in the vicinity of the both ends of the coiled filament is set to be denser than the central region, the longitudinal temperature distribution of the filament becomes uniform. Then, on the basis of such an understanding, the inventors of the present invention have developed a coiled filament for an X-ray tube. It has been found, however, that only such an improvement is not sufficient for a good uniformity of the temperature distribution.

The temperature distribution of the X-ray tube filament affects the density distribution of the electron beam which is emitted from the filament, and the density distribution further affects the brightness distribution of the X-ray focus on the target. If it is desired only to prolong the lifetime of the filament, the use of the prior art disclosed in the second or third publication would be sufficient. But, taking account of the uniformity of the X-ray focus brightness too, a more precise uniformity of the temperature distribution is required.

Next, the lifetime of the filament will be discussed. A component which has the shortest lifetime in the X-ray tube is a filament. If the lifetime of the filament is prolonged, a maintenance cost and time for the X-ray tube can be greatly saved. The major factors affecting the lifetime of the filament are nonuniformity of the longitudinal temperature distribution of the filament and bombardment of ions coming from the target.

First, there will be explained the reduction of the lifetime caused by the nonuniformity of the longitudinal temperature distribution of the filament. Since the ordinary coiled filament for an X-ray tube has a constant wire diameter and a constant coil pitch, its temperature becomes highest at the longitudinal center and drops in the vicinity of the both ends. The filament is greatly wasted at the region which is higher in temperature, and thus the wire diameter is reduced at the higher-temperature region. When the wire diameter is reduced, the electric resistance is increased to raise the heating value at the region, resulting in a much higher temperature. Under such a vicious circle, the filament is finally broken at the higher-temperature region.

Next, there will be explained the reduction of the lifetime caused by the bombardment of ions coming from the target. The filament emits an electron beam which is narrowed by an electric field made by the Wehnelt electrode to make a specified electron-beam-irradiated region on a target, so that the irradiated region generates X-rays. The electron-beam-irradiation region emits not only X-rays but also metal atom ions, i.e., positive ions, the metal atom making up the target material. The ions may occasionally collide with the filament. When the filament experiences the ion bombardment, the filament is subject to erosion disadvantageously, resulting in the filament breaking at last.

The two problems regarding the lifetime reduction may be overcome separately with the suitable countermeasures which may be found out from the prior art.

First, in the field other than the X-ray tube, a coiled filament having a particular coil pitch which is sparse in the vicinity of the center and dense in the vicinity of the both ends so as to obtain a uniform longitudinal temperature distribution is known and disclosed in the second and third publications as mentioned above.

Next, in the field of the X-ray tube, the countermeasures in which the position of the filament is shifted from the position facing the electron-beam-irradiation region is known and disclosed in Japanese patent publication No. 5-242842 A (1993), which will be referred to as the fourth publication, and Japanese patent publication No. 2001-297725 A, which will be referred to as the fifth publication.

Each of the fourth and fifth publications discloses a combination of a couple of the eccentric filaments. The opening of the Wehnelt electrode is formed asymmetric about the filament so that the electron-beam-irradiation region on the target can be deviated from the filament center extension line. As a result, the filament becomes less subject to the ion bombardment.

The inventors of the present invention have been dedicated to make a study on elongation of the lifetime of the X-ray tube filament and finally found out that it is most effective for the long lifetime of the filament to attain at the same time the both of (1) dissolving the nonuniformity (especially a higher temperature at the longitudinal central region than other regions) of the temperature distribution of the filament and (2) reducing the ion bombardment on the filament.

SUMMARY OF THE INVENTION

It is an object of the present invention to provide a coiled filament for an X-ray tube in which the temperature distribution along the longitudinal direction of the filament becomes very uniform.

It is another object of the present invention to provide an X-ray tube having such a filament.

It is further another object of the present invention to provide an X-ray tube in which the temperature distribution along the longitudinal direction of the coiled filament becomes uniform and the filament is less subject to the bombardment of ions coming from the electron-beam-irradiation region, so that the lifetime of the filament is prolonged.

A filament for an X-ray tube according to the present invention is a coiled filament which comprises: a central region including plural turns having the same coil pitch; and end regions which are arranged on either side of the central regions and include plural turns each of which has a coil pitch smaller than the coil pitch of the central region. The coil pitches of the plural turns of the end regions are reduced one by one by the same variation from the turn close to the central region toward the outermost turn. Assuming that p is the coil pitch of the central region, Δp is the coil pitch variation of the end regions, n is a total number of turns of the filament, and k is a sum of numbers of turns of the end regions, Δp/p should be within a range of 0.015 to 0.1 and k/n should be within a range of 0.3 to 0.8.

The k/n should preferably satisfy the following equation:

$$k/n=0.72-4.66(\Delta p/p)\pm 0.12.$$

An X-ray tube according to the present invention comprises a filament having the feature mentioned above.

The present invention described above has an advantage that the longitudinal temperature distribution of the coiled filament becomes uniform, which is accomplished by the improvement in the coil pitch. For example, when the filament is heated to about 2,500 degrees C. in temperature, the longitudinal temperature distribution falls within 50 degrees C. except for the outermost two turns at each end.

In addition, an X-ray tube according to another aspect of the present invention comprises: an electron gun which includes a Wehnelt electrode formed with an elongate opening and a coiled filament disposed inside the opening to emit an electron beam; and a target which is irradiated with the electron beam to generate an X-ray beam. The feature regarding the Wehnelt electrode is that the opening has two longer sides positioned asymmetrically about a center-of-width line of the filament. The feature regarding the filament is that the filament includes: a central region including plural turns having the same coil pitch; and end regions which are arranged on either side of the central regions and include plural turns each of which has a coil pitch smaller than the coil pitch of the central region. In other words, the filament is a dense-and-sparse winding filament. In the dense-and-sparse winding filament, the coil pitches of the plural turns of the end regions are reduced one by one by the same variation from the turn close to the central region toward the outermost turn.

The dense-and-sparse winding filament preferably has the following features for making the temperature distribution of the filament more uniform. Assuming that p is the coil pitch of the central region, Δp is the coil pitch variation of the end regions, n is a total number of turns of the filament, and k is a sum of numbers of turns of the end regions, Δp/p should be within a range of 0.015 to 0.1 and k/n should be within a range of 0.3 to 0.8. Further, k/n should preferably satisfy the following equation:

$$k/n=0.72-4.66(\Delta p/p)\pm 0.12.$$

In connection with the shape of the opening of the Wehnelt electrode, one of the following features may be adopted preferably so that the electron-beam-irradiation region on the target is not curved. (1) Each of the two longer sides is curved in the same direction as viewed in a direction normal to a front face of the Wehnelt. In this case, each of the two longer sides of the opening may preferably have a shape consisting of a circular arc with a curvature radius which is different from a curvature radius of another longer side. (2) The two longer sides are curved in opposite directions relative to each other as viewed in a direction which is parallel to a front face of the Wehnelt electrode and yet perpendicular to a longitudinal direction of the opening. (3) The electron-beam-irradiation region on the target has an elongate shape, and the two longer sides of the opening are curved so that the electron-beam-irradiation region has a curvature coefficient being not greater than 0.01.

An X-ray tube according to the above-described aspect of the present invention has an advantage that, with the use of both the dense-and-sparse winding filament and the eccentric filament configuration, the longitudinal temperature distribution of the filament becomes uniform and also the filament is less subject to the bombardment of ions coming from the electron-beam-irradiation region, resulting in the long lifetime of the filament with a synergistic effect.

BRIEF DESCRIPTION OF THE DRAWINGS

FIG. 4 shows a table indicating the analytical results;

DETAILED DESCRIPTION OF THE PREFERRED EMBODIMENTS

Figure 1:
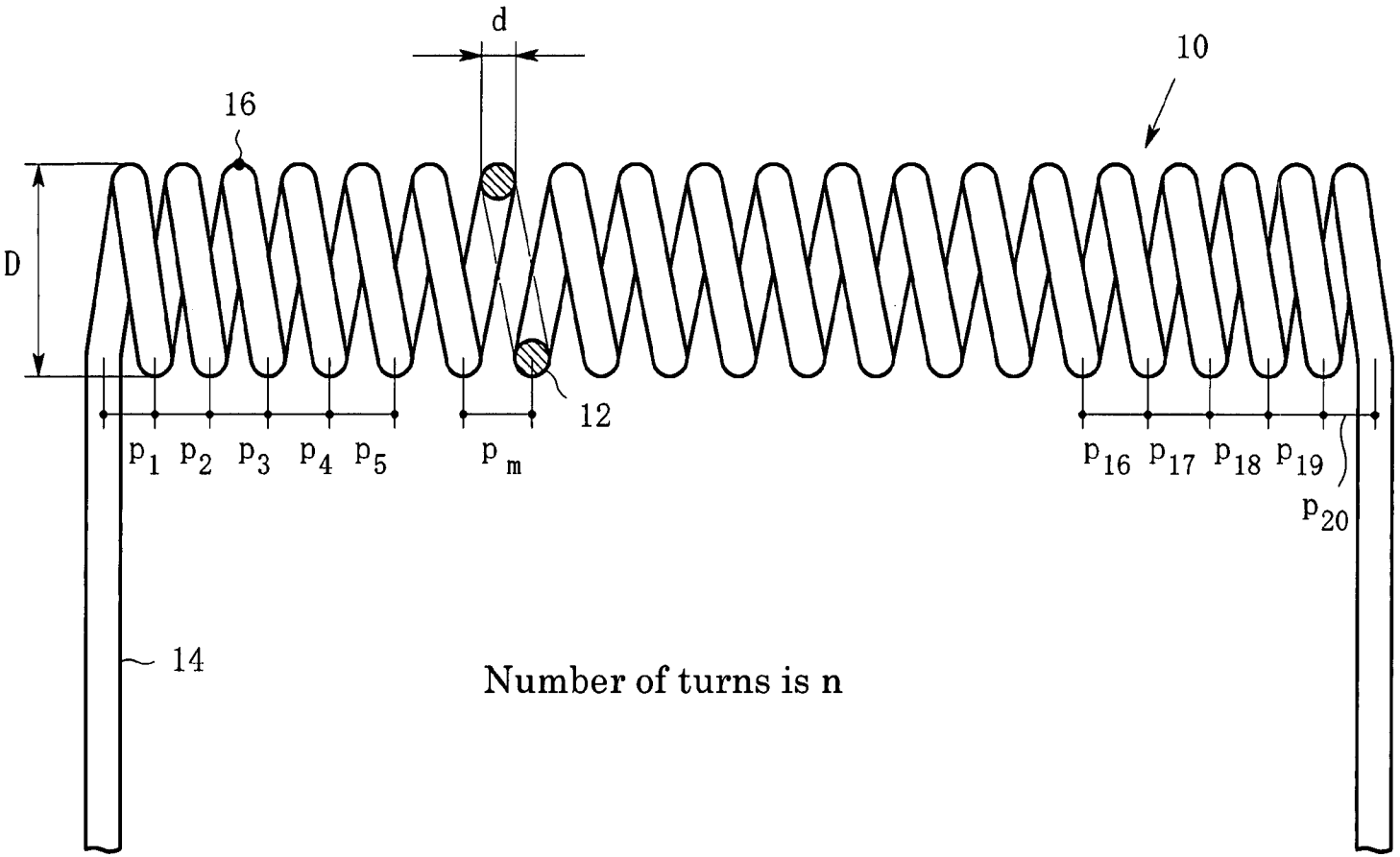
FIG. 1 is a front view of one embodiment of a filament according to the present invention.

Embodiments of the present invention will now be described in detail below with reference to the drawings. Referring to FIG. 1 which is a front view of one embodiment of a filament according to the present invention, a filament 10 is made of a wire 12 having a wire diameter d, the wire 12 being wound with n-turns to be a coiled shape having an outside diameter D. The both ends of the filament 10 are integrally connected to lead wires 14. In this embodiment, the number of turns n is twenty. In the figure, the leftmost turn will be referred to as the first turn hereinafter, and the other turns are, toward to the right, the second turn and the third turn and so on, and finally the rightmost turn is the twentieth turn. The coil pitch of the first turn is $p_1$, and the coil pitch of the second turn is $p_2$, and so forth. The coil pitch of the rightmost, twentieth turn is $p_{20}$. In general, the coil pitch of the m-th turn is $p_m$, where m is 1 to n. The coil pitch will be referred to as merely a pitch hereinafter.

In the filament shown in the figure, the sixth to fifteenth turns have the same pitch. The region consisting of the plural turns which have the same pitch will be referred to as the central region, and the pitch is denoted by p. Namely, $p_6=P_7= \ldots =p_{15}=p$. The first to fifth turns have pitches smaller than the pitch of the central region. In other words, the winding of the first to fifth turns is denser than the central region. The sixteenth to twentieth turns have the similar feature. The region having pitches smaller than the pitch of the central region will be referred to as an end region. The fifth turn has a pitch $p_5$ which is smaller by Δp than the pitch of the central region. Further, the fourth turn has a pitch p4 which is further smaller by Δp than $P_5$. Similarly, the pitches in the end region are reduced one by one toward the first turn. That is to say, in the left end region of the filament in the figure, the pitches are reduced one by one by Δp from the fifth turn (i.e., the turn close to the central region) toward the first turn (i.e., the outermost turn). Explaining with an equation, $p-p_5=p_5-p_4=p_4-p_3=p_3-p_2=p_2-p_1=\Delta p$. The right end region of the filament in the figure has the similar feature, that is, $p-p_{16}=p_{16}-p_{17}=p_{17}-p_{18}=p_{18}-p_{19}=p_{19}-p_{10}=\Delta p$.

Figure 2:
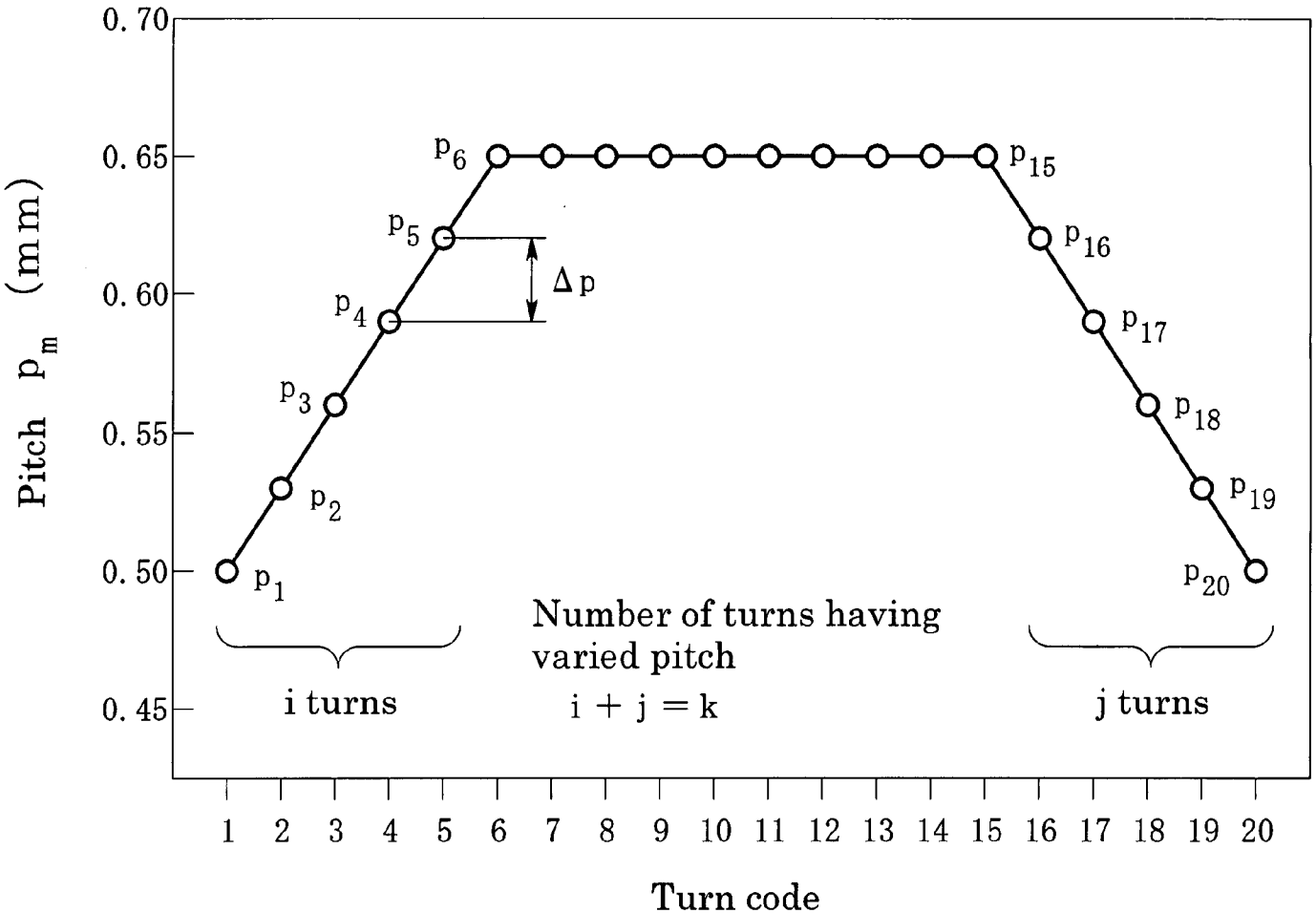
FIG. 2 is a graph showing a variation of the coil pitch of the filament shown in FIG. 1.

FIG. 2 is a graph showing a variation of the coil pitch of the filament shown in FIG. 1, in which the turn code is in abscissa and the pitch of each turn is in ordinate. In the embodiment, each of the sixth to fifteenth turns in the central region has the pitch p which is fixed to 0.65 mm (650 micrometers). The pitch $p_5$ of the fifth turn is smaller by Δp, which is 30 micrometers, than the pitch p of the central region. Therefore, $p_5$ is 0.62 mm. Similarly, the pitches are reduced one by one by the same variation Δp. Namely, $p_4$ is 0.59 mm, $p_3$ is 0.56 mm, $p_2$ is 0.53 mm, and $p_1$ is 0.50 mm. Similarly in the right end region in the figure, $p_{16}$ is 0.62 mm, $p_{17}$ is 0.59 mm, $p_{18}$ is 0.56 mm, $p_{19}$ is 0.53 mm, and $p_{20}$ is 0.50 mm.

In the left end region, the number of turns which have the varied coil pitch as compared with the central region is denoted by i which is five. In the right end region, the number of turns which have the varied coil pitch as compared with the central region is denoted by j which is five too. The sum of i and j is denoted by k which is ten. Accordingly, in the embodiment, the number of turns consisting of the central region is 10 and the sum (i.e., k) of the numbers of turns consisting of respective end regions (i.e., the number of turns which have the varied coil pitch) is 10.

Figure 3:
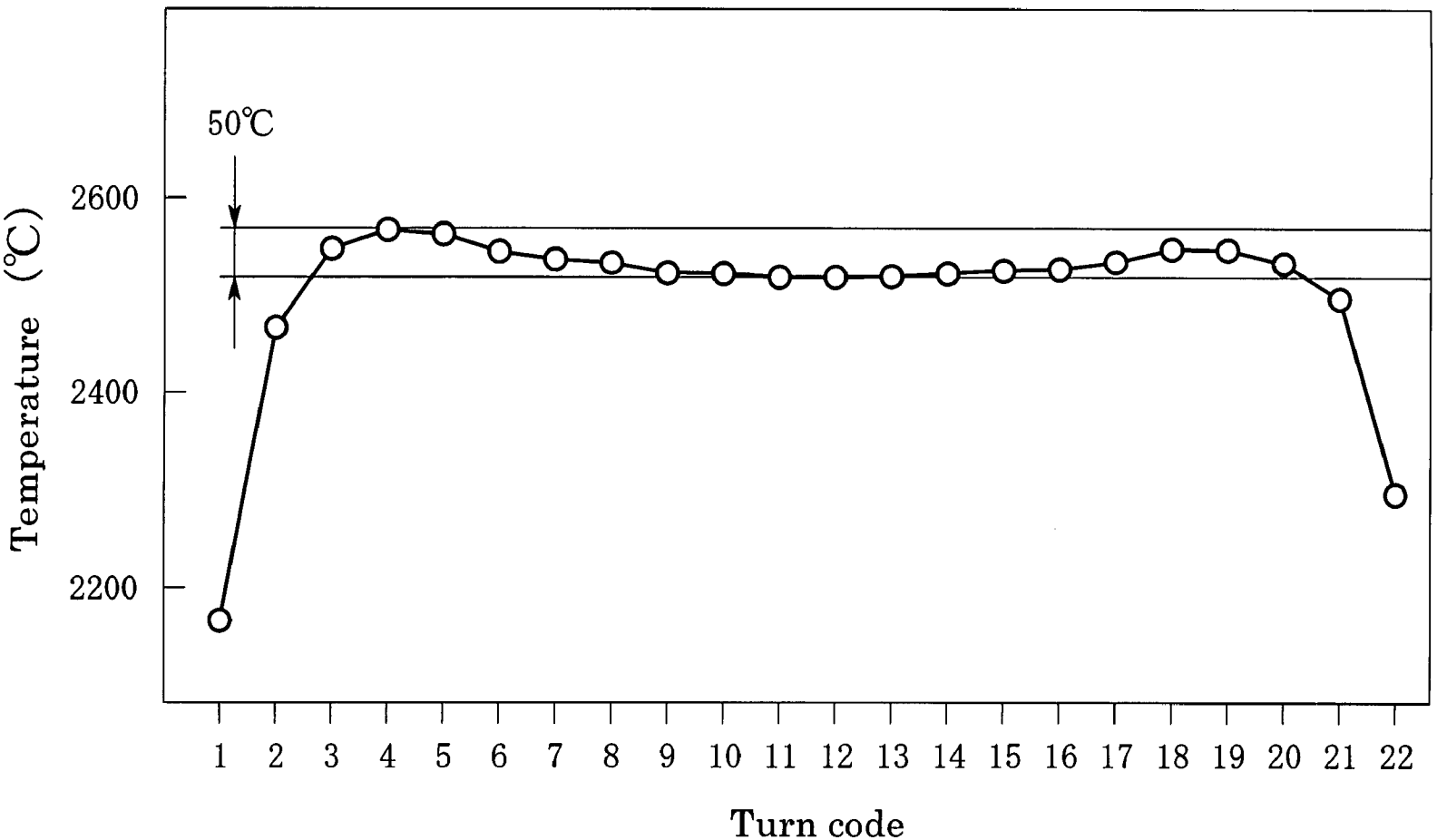
FIG. 3 is a graph showing the longitudinal temperature distribution of the filament.

FIG. 3 is a graph showing the longitudinal temperature distribution of a filament which is different from the filament shown in FIG. 1. The filament has a coil specification which is as follows: the number of turns is twenty two; d is 0.4 mm; D is 3 mm; p is 0.65 mm; Δp is 0.03 mm; i is five; j is five; and thus k is ten. An electric current was supplied to the filament to heat it to about 2,500 degrees C. and the longitudinal temperature distribution of the filament was measured as shown in the graph of FIG. 3. In the graph, the turn code is in abscissa and the temperature is in ordinate. The temperature of each turn was measured at the uppermost point 16 (see FIG. 1) of each turn with the use of an optical pyrometer. Since the filament has the end regions whose pitches are denser than the central region, the temperature of the central region becomes not higher than the end regions. In the embodiment, the temperature of the central region becomes rather slightly lower than the end regions. The temperature distribution in a region from the third turn to the twentieth turn falls within 50 degrees C. Only the first, second, twenty-first, and the twenty-second turns are out of the range of 50 degrees C.

The temperature distribution was not only actually measured as shown in FIG. 3 but also calculated with theoretical calculation. The theoretical calculation was carried out with the following steps: the finite element method was used to calculate the temperature with an electric current and thermal radiation as variables; and Δp and k (=i+j) was determined so as to make the temperature uniform as far as possible. The resultant theoretical temperature showed a tendency which is similar to the measured temperature distribution shown in FIG. 3. Therefore, in the discussion described below, Δp and k were obtained with the theoretical calculation so as to make the temperature distribution uniform as far as possible.

FIG. 4 shows a table indicating the analytical results. In the table, the optimum value of k was obtained, with the pitch variation Δp as a parameter, for each of filaments having various coil specifications so as to make the longitudinal temperature distribution of the filament within a temperature range of 50 degrees C. at about 2,500 degrees C., except for the temperature of two turns of each end. The coil specification includes a wire diameter d, an outside diameter D, the number of turns n, and the pitch p of the central region. The analytical results were obtained in view of what the value of k is suitable for each Δp for obtaining the above-mentioned good temperature distribution, the Δp being the parameter.

For example, when the coil specification is that d is 0.2 mm, D is 1.13 mm, n is twenty and p is 0.65 mm and the pitch of the end regions of the filament is varied with Δp being 20 micrometers, the analytical result is that if i+j=k=8 to 10, the temperature distribution falls within 50 degrees C. The "Ave" disposed next to k column in the table of FIG. 4 is an average of the optimum range of k which is 8 to 10 for example. When the optimum value of k is 8 to 10, four or five turns at each end should have coil pitches which are reduced one by one from the turn close to the central region.

Figure 5:
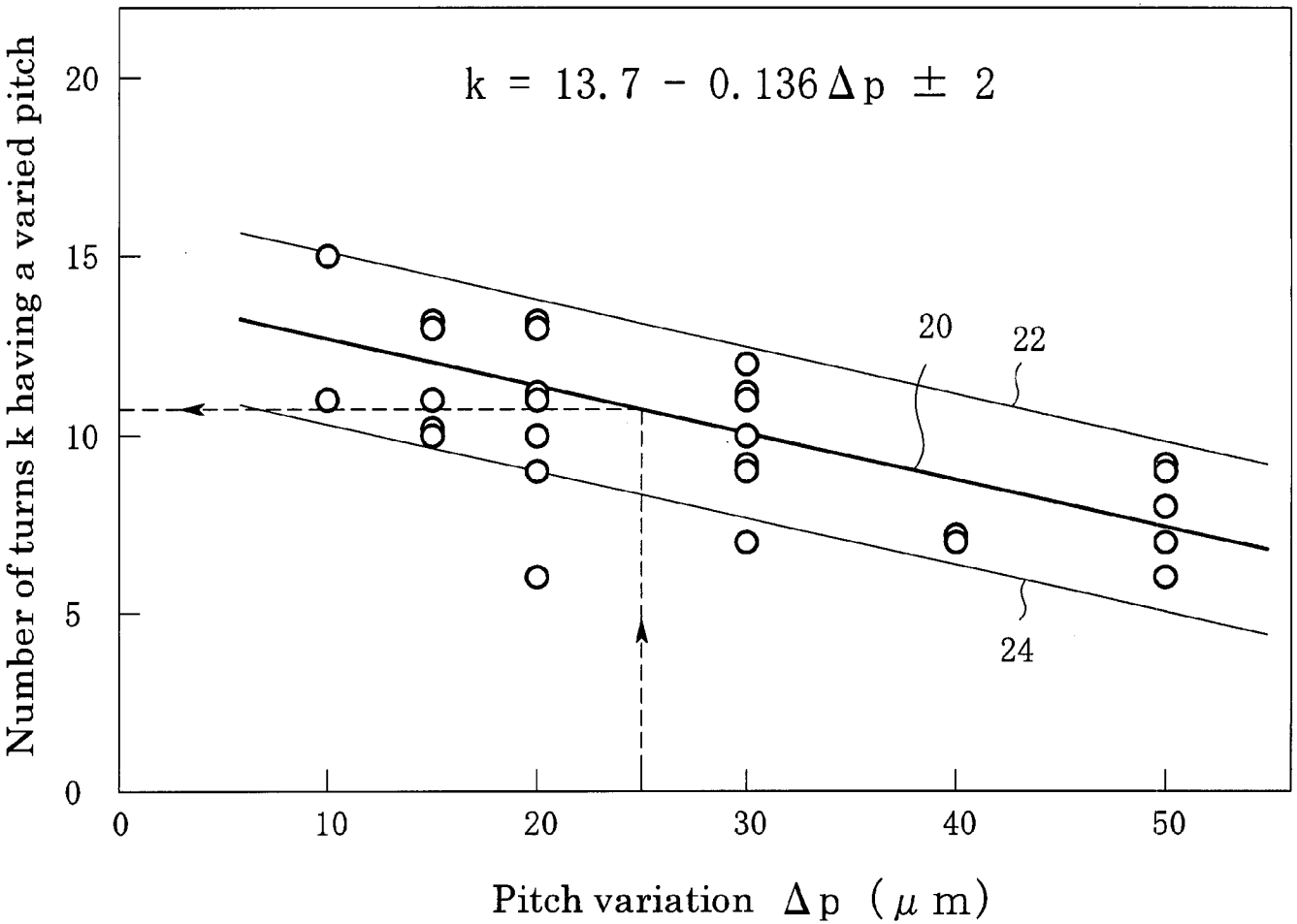
FIG. 5 is a graph showing the analytical results.

FIG. 5 is a graph showing the analytical results shown in the table of FIG. 4, in which the pitch variation Δp is in abscissa and the number of turns k having a varied pitch is in ordinate. The data for all filaments having various coil specifications are shown in the same graph. The graph indicates that the data for all coil specifications have the same tendency regarding a relationship between Δp and k, that is, larger the pitch variation Δp, the smaller the optimum value of k. A line 20 which passes through the center of the data distribution, strictly speaking a line 20 obtained with the least squares method, satisfies an equation of "k=13.7−0.136Δp". With the use of the line 20, it is understood that when Δp is selected to 25 micrometers, the optimum value of k is 10 to 11 for the most uniform temperature distribution.

A line 22 has k which is obtained by adding two to k of the line 20, while a line 24 has k which is obtained by subtracting two from k of the line 20. The all data falls almost within a range between the lines 22 and 24. Accordingly, if Δp and k are selected so as to satisfy the equation of "k=13.7−0.136Δp±2", a filament having a uniform temperature distribution is obtained.

Figure 6:
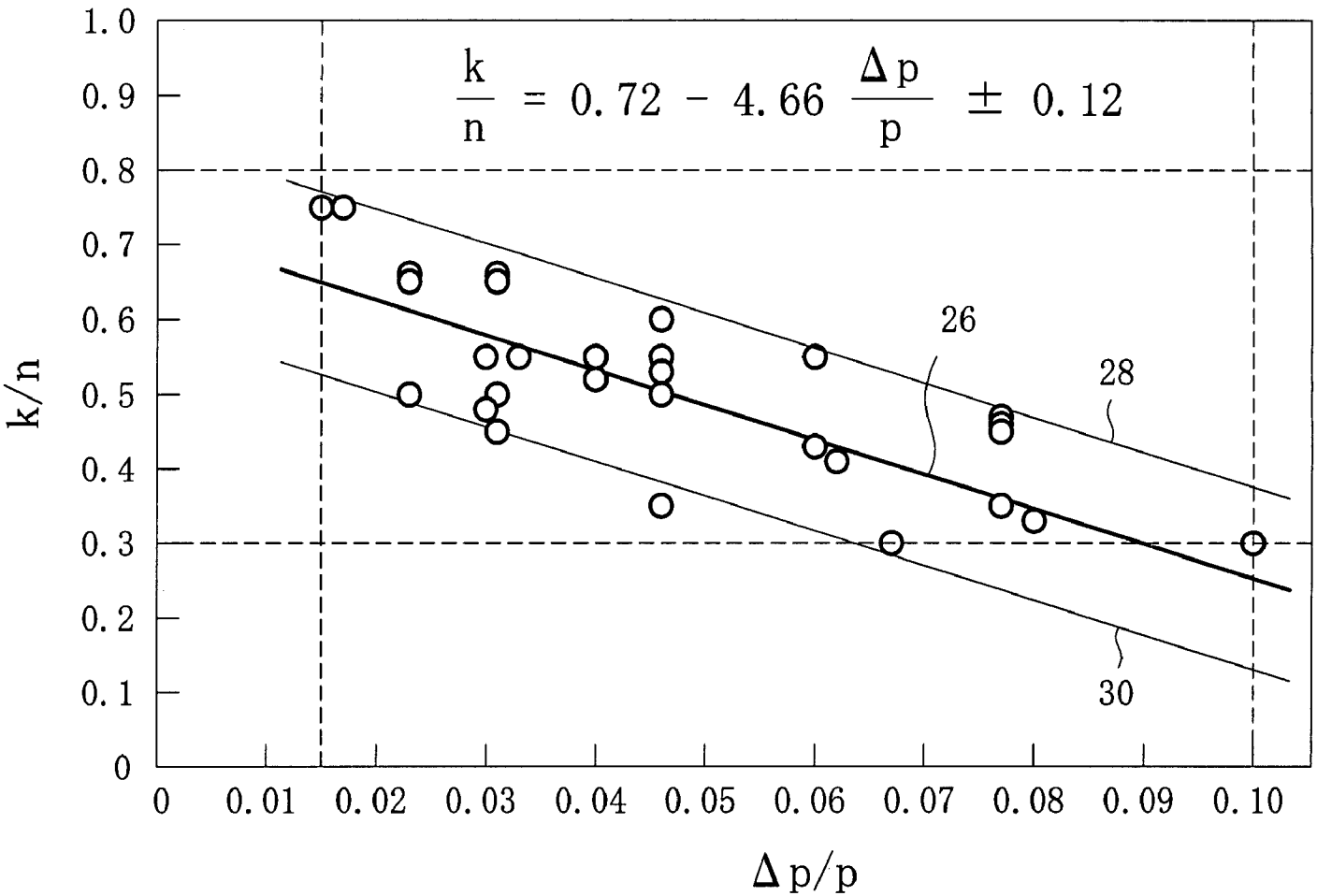
FIG. 6 is another graph of the analytical results.

FIG. 6 is a graph which indicates a relationship between Δp and k, provided that they are normalized by p and n. In the graph the pitch variation Δp divided by the pitch p of the central region is in abscissa and the number of turns k having a varied pitch divided by the total number of turns n is in ordinate. With the normalization, there is obtained a more general relationship not depending on the number of turns n and the pitch p. The data falls within a range of 0.015 to 0.1 in Δp/p and within a range of 0.3 to 0.8 in k/n. Since the filaments having the data within the ranges showed the temperature distribution within 50 degrees C. at about 2,500 degrees C., the values of Δp/p and k/n should preferably be selected within the ranges.

A line 26 which passes through the center of the data distribution satisfies an equation of "(k/n)=0.72−4.66 (Δp/p)". Drawing lines 28 and 30 which are obtained by adding 0.12 to k/n of the line 26 and by subtracting 0.12 from k/n of the line 26, the all data falls almost within a range between the lines 26 and 28. The range satisfies an equation of "(k/n)=0.72−4.66(Δp/p)±0.12". If the values of Δp/p and k/n are selected so as to satisfy the equation, there is obtained a filament having a uniform temperature distribution.

Figure 7:
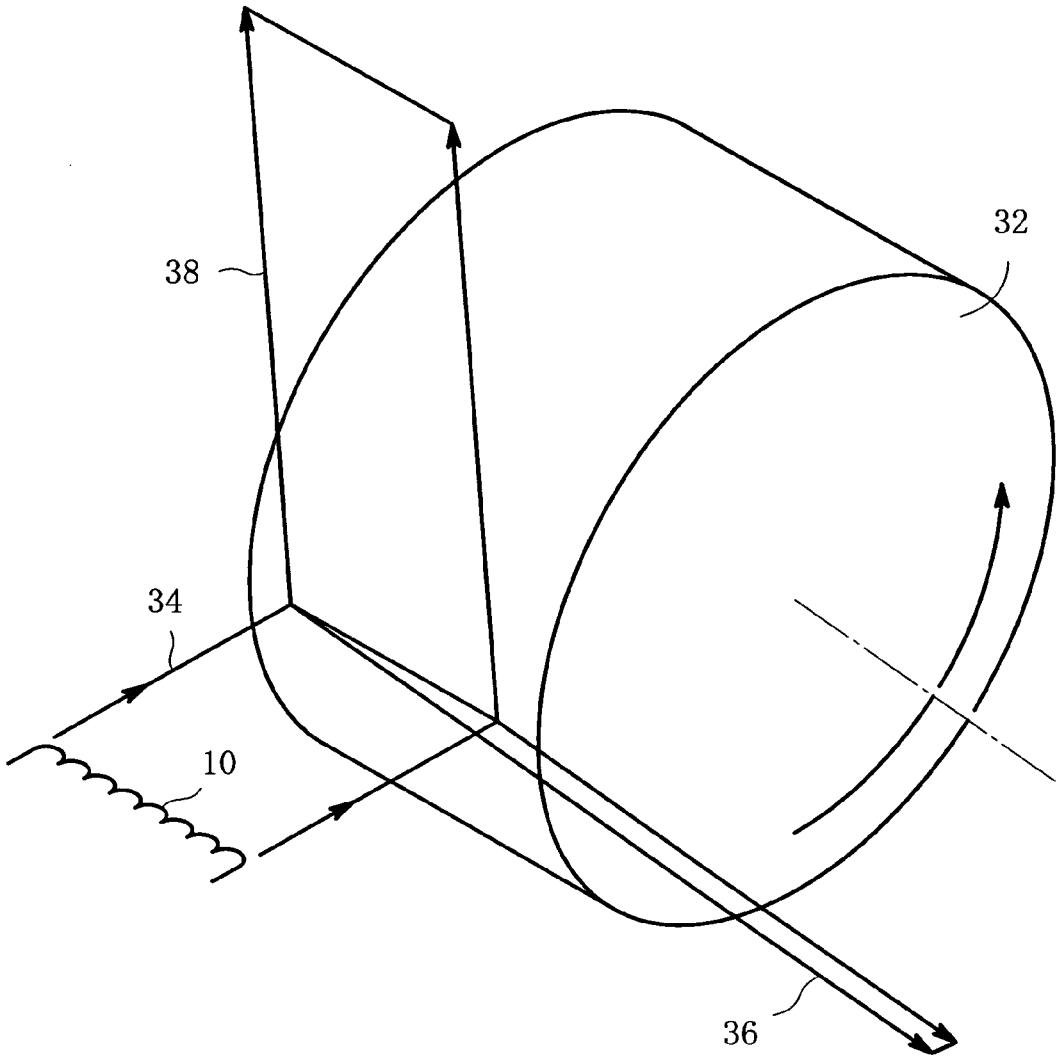
FIG. 7 is a perspective view of a major part of an X-ray tube having a filament according to the present invention.

FIG. 7 is a perspective view of a major part of an X-ray tube having the filament which has the improvement mentioned above. When an electric current is supplied to the filament 10 and a high voltage is supplied between the filament 10 and a rotating anode 32, the filament 10 emits an electron beam 34. The electron beam 34 impinges against the periphery of the rotating anode 32 to generate an X-ray beam, which may be taken out, for example, as a point focus X-ray beam 36 or a line focus X-ray beam 38.

Figure 8:
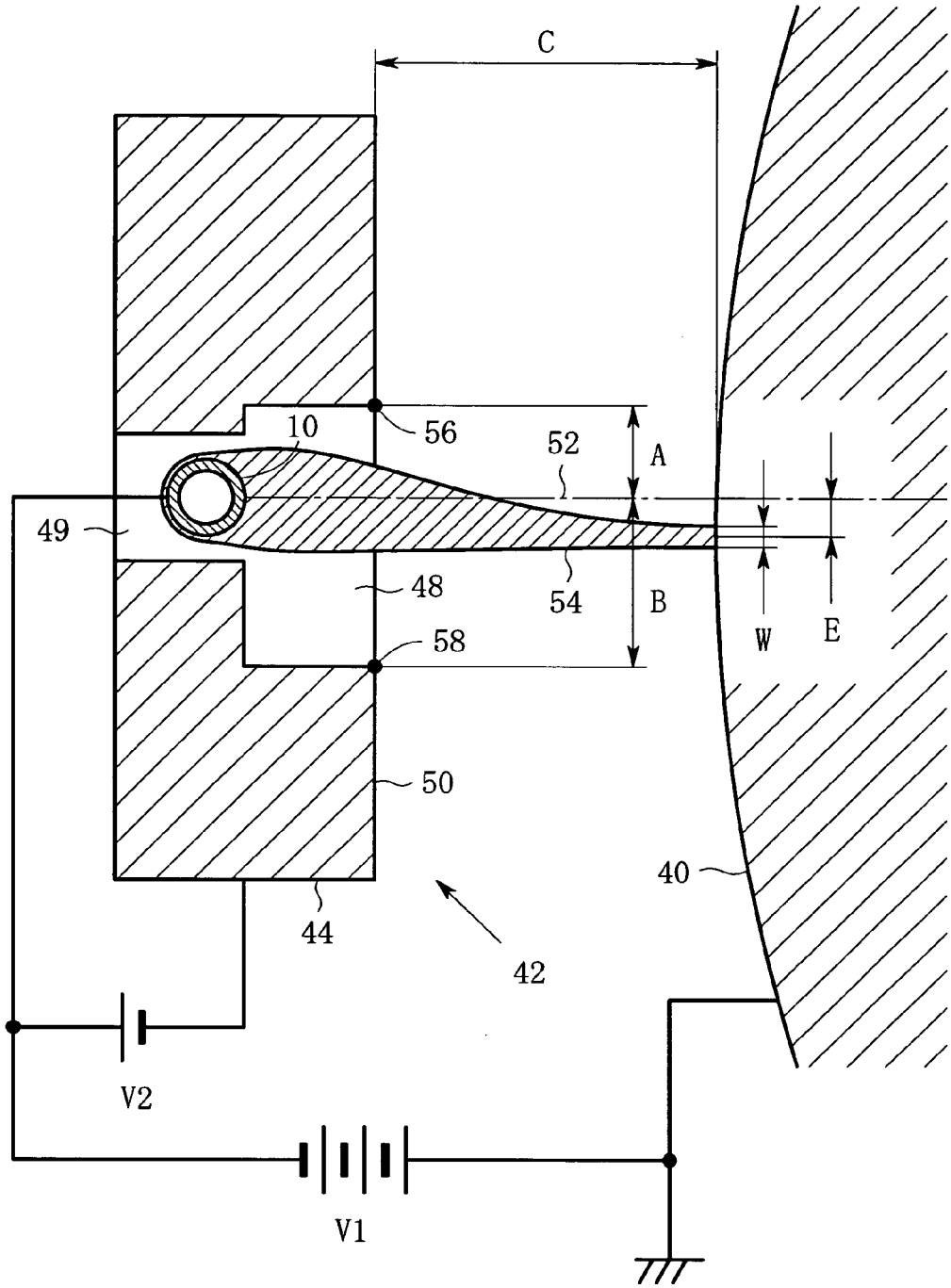
FIG. 8 is a sectional view showing the eccentric filament configuration.

Next, there will be explained the wehnelt electrode, which has the eccentric filament configuration, for use in an X-ray tube according to the present invention. FIG. 8 is a sectional view showing the eccentric filament configuration. The figure shows a condition in which an electron gun 42 faces a revolving target 40 (i.e., rotating anode). The electron gun 42 includes a Wehnelt electrode 44 and a coiled filament 10 which is disposed inside an opening 48 formed in the Wehnelt electrode 44. The opening 48 and the filament 10 extend long in a direction perpendicular to the drawing sheet. A line 52, which passes through the center-of-width of the filament 10 and yet is perpendicular to the front face 50 of the Wehnelt electrode 44, is referred to as a filament center extension line hereinafter. The eccentric filament configuration has a feature that the center-of-width of the electron-beam-irradiation region on the target 40 is deviated from the filament center extension line 52 by a distance E which is about a half width of the filament 10. In other words, the opening 48 of the Wehnelt electrode 44 is formed asymmetric about the center-of-width of the filament 10. Stating in detail, a distance A between the filament center extension line 52 and one longer side 56 (which extends in a direction perpendicular to the drawing sheet) of the opening 48 is different from another distance B between the filament center extension line 52 and the other longer side 58 (which also extends in a direction perpendicular to the drawing sheet) of the opening 48, the distance A being shorter than the distance B. Accordingly, the electric field made by the Wehnelt electrode 44 asymmetrically affects the electron beam 54, so that the electron beam 54 is deflected downward as shown in FIG. 8, resulting in the deviation of the electron-beam-irradiation region by the distance E as described above.

Figure 10:
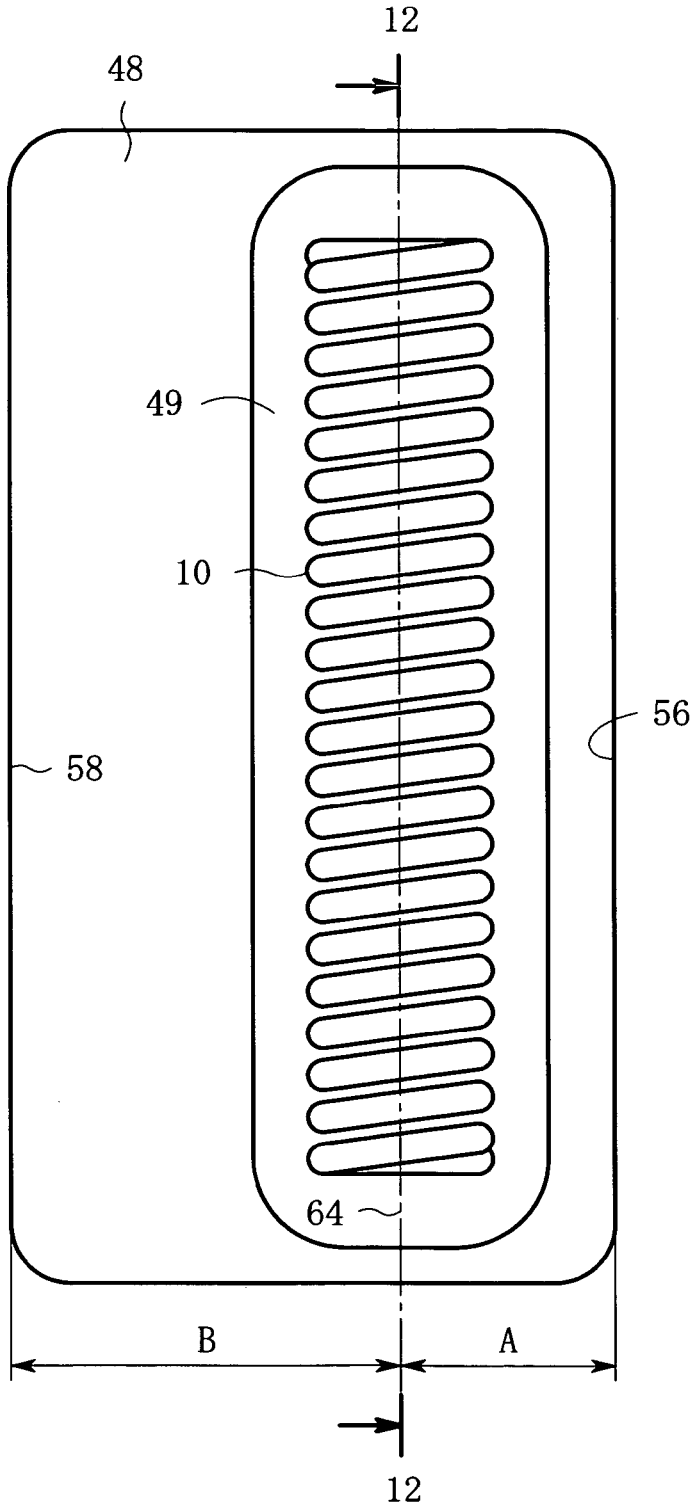
FIG. 10 is an enlarged view showing the opening of the Wehnelt electrode.

FIG. 10 shows a positional relationship between the opening 48 of the Wehnelt electrode and the filament 10. The opening 48 and the filament 10 each has an elongate shape as a whole. The distance A between the center-of-width line 64 of the filament 10 and one longer side 56 of the opening 48 is different from the distance B between the center-of-width line 64 and the other longer side 58, the longer sides 56 and 58 being straight lines.

Figure 9:
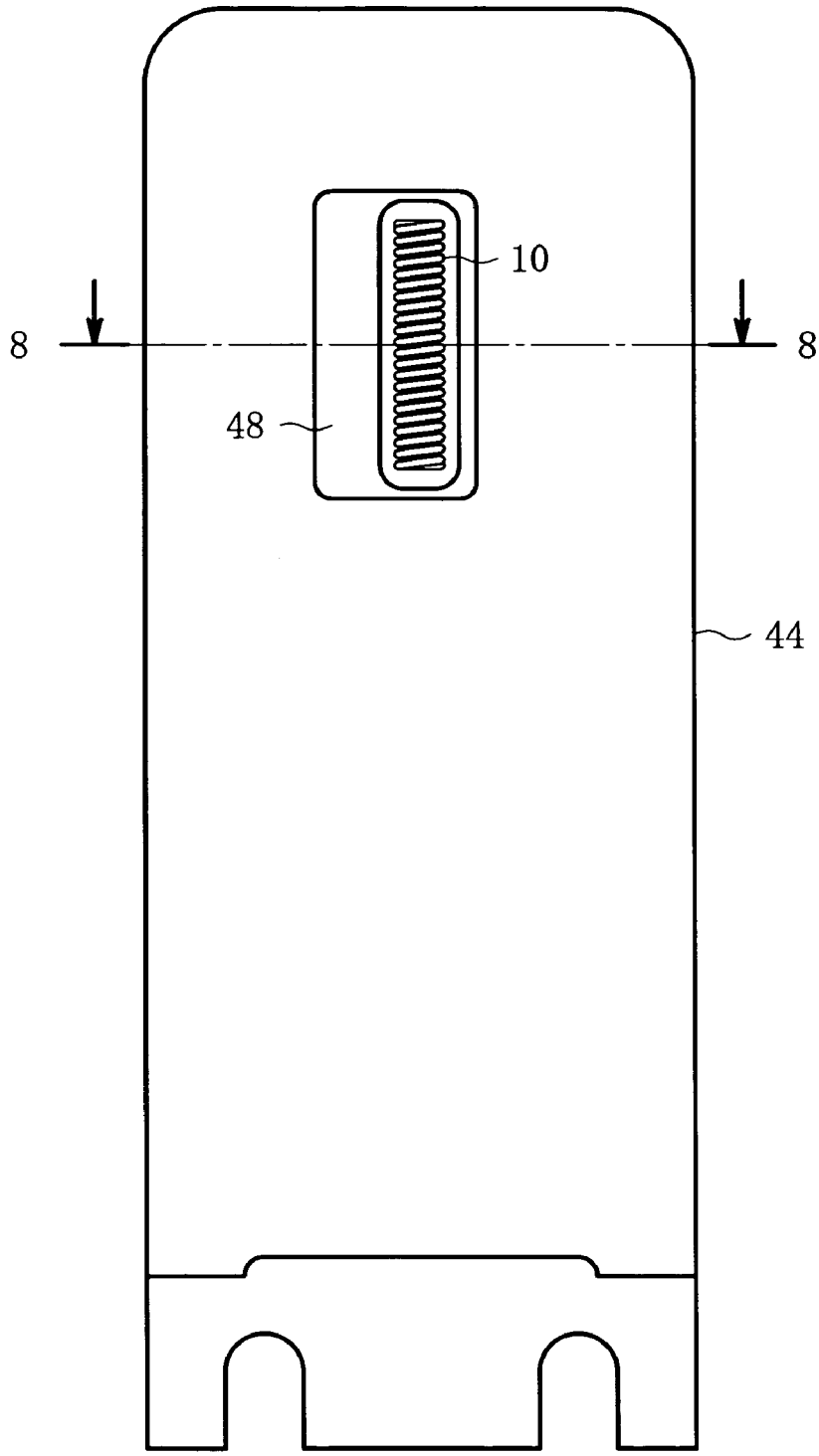
FIG. 9 is a front view showing a basic shape of the electron gun with the eccentric filament configuration.

Referring to FIG. 9 which is a front view showing a basic shape of the electron gun with the eccentric filament configuration, a Wehnelt electrode 44 is formed with an elongate opening 48 inside which an elongate coiled filament 10 is disposed. The sectional view of the electron gun 42 shown in FIG. 8 corresponds to a view taken along line 8—8 in FIG. 9. Referring back to FIG. 10 which is an enlarged view showing the opening 48 of the Wehnelt electrode 44, the opening 48 has an elongate rectangular shape as a whole and has two longer sides 56 and 58. The opening 48 communicates with a filament reception room 49 which has a rectangular shape smaller than the opening 48 as viewed from the front of the Wehnelt electrode 44. The filament reception room 49 is, as shown in FIG. 8, positioned downward by a certain distance from the front face 50 of the Wehnelt electrode 44. Referring back to FIG. 10, a distance between one longer side 56 of the opening 48 and the center-of-width line 64 of the filament 10 is denoted by the symbol A while a distance between the other longer side 58 and the center-of-width line 64 is denoted by the symbol B, the distance B being larger than the distance A.

In the embodiment, the coil of the filament 10 has an outside diameter of 2.4 mm and the filament 10 has a length of 10.5 mm. The measure of the opening 48 is 16 mm long and 8.2 mm wide as viewed from the front of the Wehnelt electrode 44 (i.e., as viewed in a direction normal to the front face), while the filament reception room 49 is 15 mm long and 4 mm wide. The distance A is 2.9 mm while the distance B is 5.3 mm.

Referring back to FIG. 8, a negative high voltage V1 (i.e., an acceleration voltage) is supplied to the filament 10 relative to the target 40, while a negative bias voltage V2 is supplied to the Wehnelt electrode 44 relative to the filament 10. In this embodiment, for example, the acceleration voltage V1 is 45 kV and the bias voltage V2 is 200 V. A distance C between the front face 50 of the Wehnelt electrode-44 and the surface of the target 40 is 10.5 mm. The eccentric distance E becomes about 1.2 mm under the condition, the value being equal to about a half of the coil outside diameter of the filament 10.

Figure 15A:
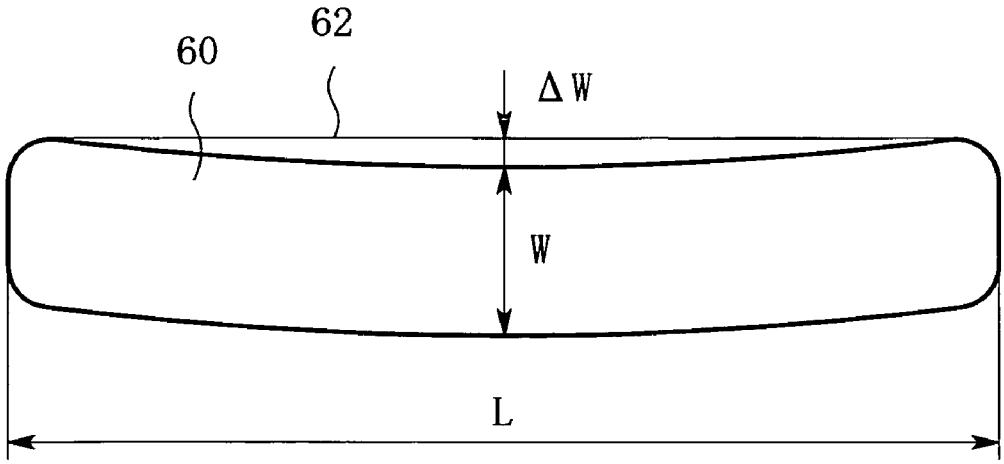
FIGS. 15A and 15B are illustrations showing two shapes of the electron-beam-irradiation region.

When the eccentric filament configuration is adopted, the electron-beam-irradiation region on the target is curved disadvantageously. Namely, as shown in FIG. 15A, the electron-beam-irradiation region 60 is curved. In the case of uses which bring the curved shape into question, some modifications of the opening of the Wehnelt electrode may preferably be adopted as described below.

Figure 11:
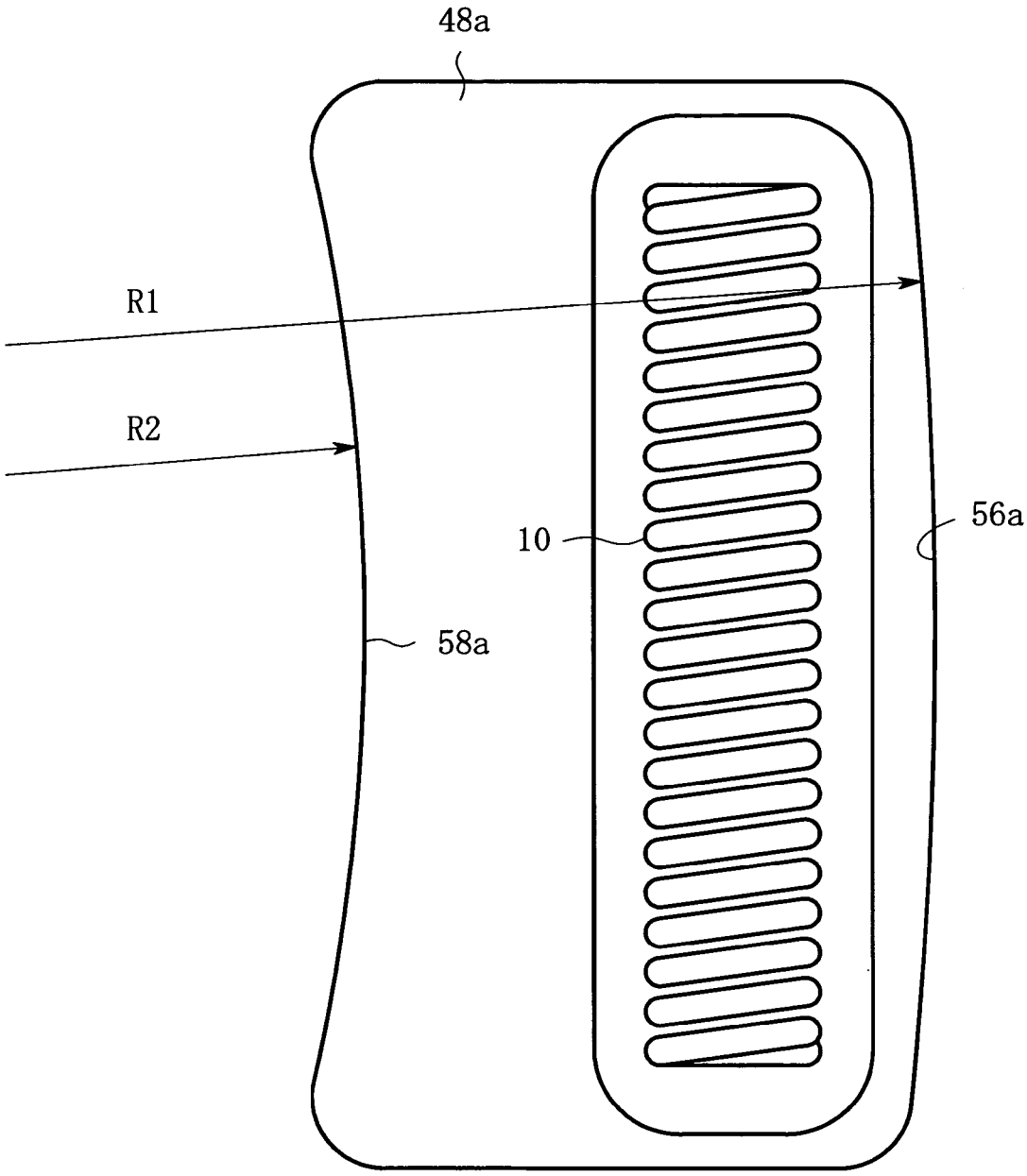
FIG. 11 shows the shape of an opening of the Wehnelt electrode in the first modification.
Figure 15B:
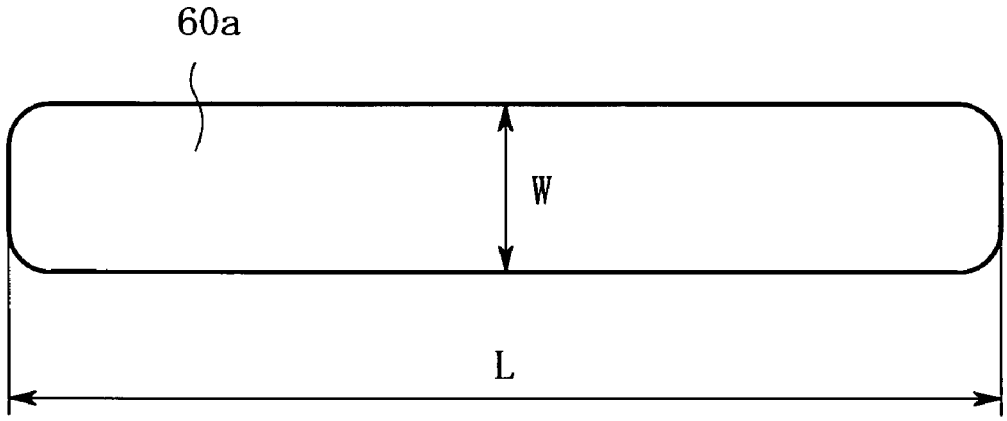

FIG. 11 shows the shape of an opening of the Wehnelt electrode in the first modification, as viewed in a direction normal to the front face of the Wehnelt electrode. The opening 48*a* has an elongate rectangular shape as a whole and has two longer sides 56*a* and 58*a* made of circular arcs which are curved in the same direction. The one longer side 56*a* is curved with a curvature radius R1 while the other longer side 58*a* is curved with another curvature radius R2. With the curved longer sides of the opening, the electron-beam-irradiation region on the target becomes almost straight. In this embodiment, R1 is 150 mm and R2 is 64.7 mm. FIG. 15B shows the shape of the electron-beam-irradiation region 60*a* made by the electron gun having the opening 48*a* shown in FIG. 11, in which W is 0.43 mm and L is 6.35 mm. It is noted that the shape of the electron-beam-irradiation region 60*a* has been determined by measurement of the focus shape of an X-ray beam which was generated from the electron-beam-irradiation region.

Figure 13:
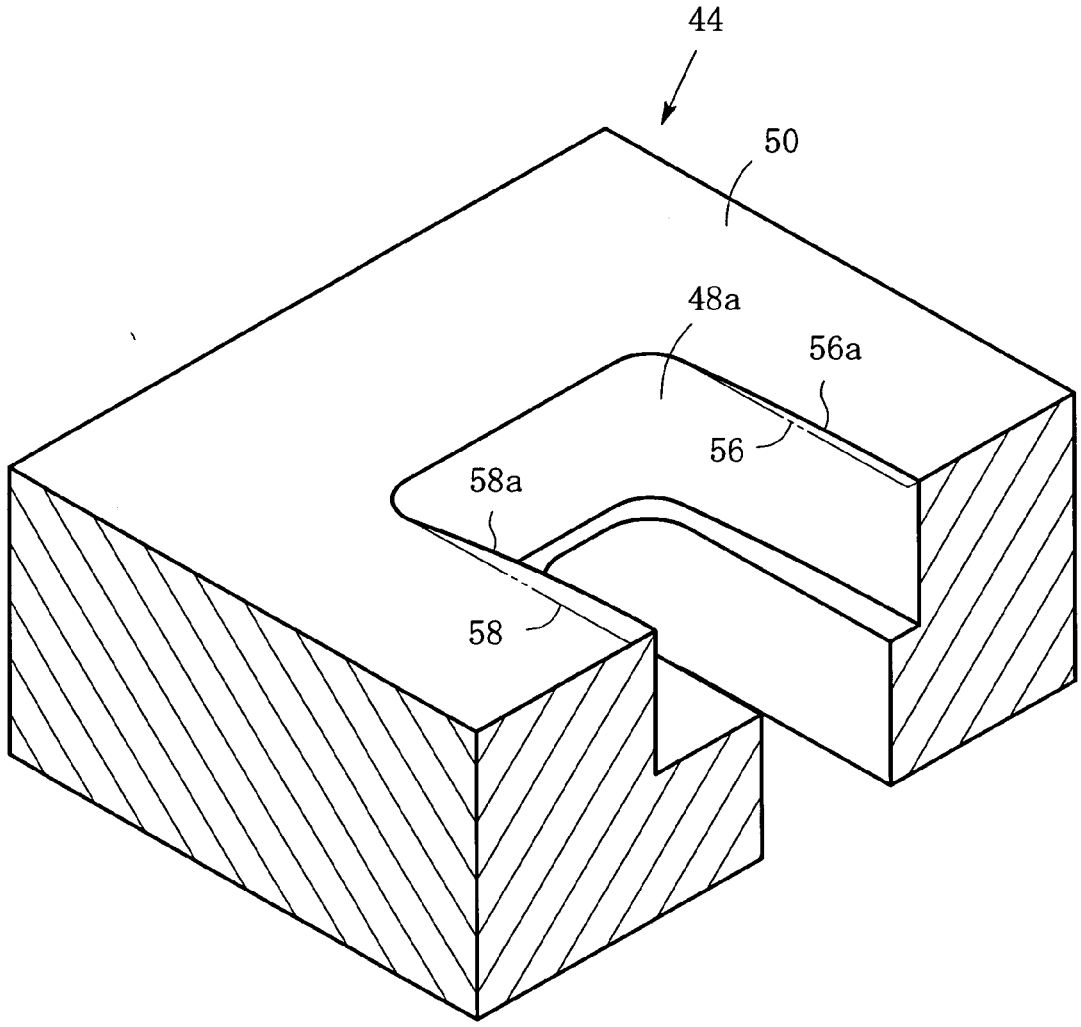
FIG. 13 is a perspective view showing a part of the opening shown in FIG. 11.

FIG. 13 is a perspective view showing a part of the opening 48*a* shown in FIG. 11, a part of the Wehnelt electrode being cut out and being shown in section at the longitudinal midpoint of the opening 48*a*. The Wehnelt electrode 44 has a flat front face 50. The opening 48*a* has two longer sides 56*a* and 58*a* which are curved as compared with the conventional longer sides 56 and 58, which are depicted by imaginary lines, of the conventional opening 48 shown in FIG. 10.

Figure 16:
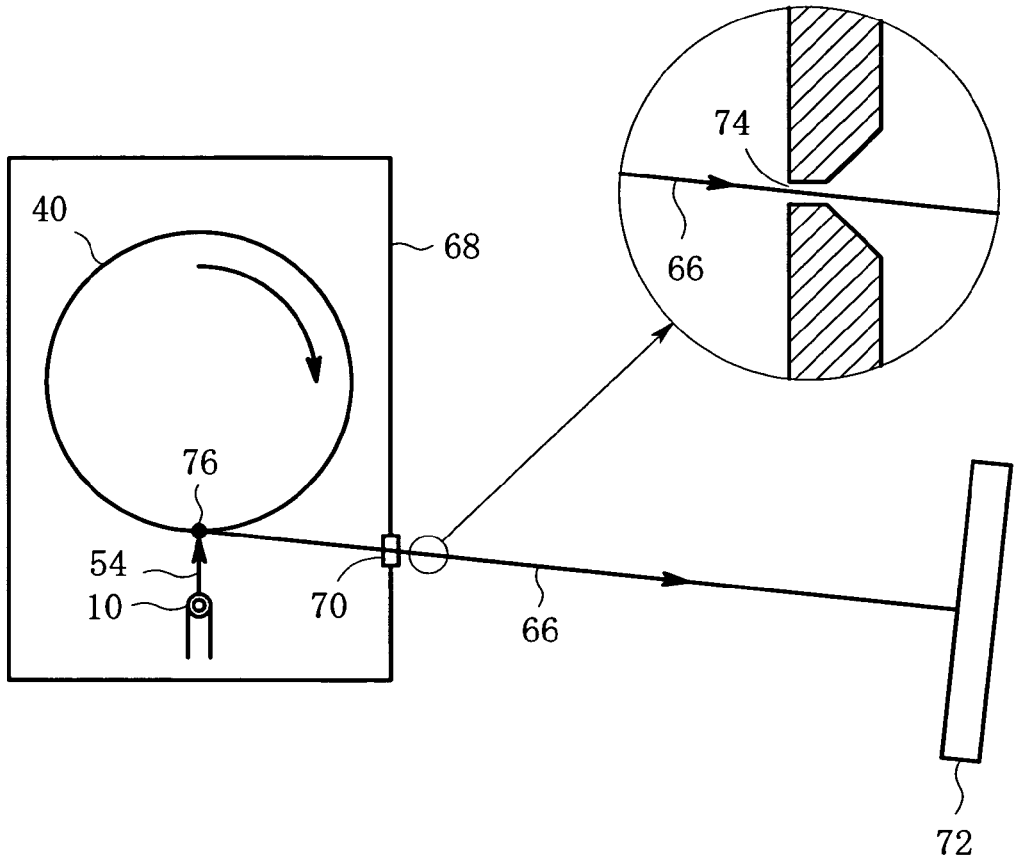
FIG. 16 is a plan view showing the principle of measurement of the shape of the electron-beam-irradiation region.

Next, there will be described a method for determining the optimum curvature radii of the two longer sides of the opening. Referring to FIG. 16 which is a plan view showing the principle of measurement of the shape of the electron-beam-irradiation region, a filament 10 (which extends long in a direction perpendicular to the drawing sheet) emits an electron beam 54 which irradiates the surface of the rotating target 40 to generate an X-ray beam 66 which is taken out from a window 70 of an X-ray tube 68 to be detected by a two-dimensional X-ray detector 72, which is a semiconductor X-ray detector consisting of CMOS devices in this embodiment. Soon after the window 70 is arranged a pinhole 74 with which a pinhole photograph of the shape of the X-ray focus 76 on the target 40 can be taken by the two-dimensional X-ray detector 72, the pinhole size being ten micrometers. A distance between the X-ray focus 76 and the pinhole 74 is 70 mm while a distance between the pinhole 74 and the two-dimensional X-ray detector 72 is 630 mm, so that there can be taken a pinhole photograph with a ninefold magnification. FIG. 15B shows a thus-obtained shape of the X-ray focus. By the way, an X-ray intensity is not uniform within the shape of the X-ray focus on the target but has a specific distribution in which an X-ray intensity decreases as the position approaches edges of the shape. Under the circumstances, the boundary of the shape of the X-ray focus is defined as the line on which an X-ray intensity is equal to a half of the maximum intensity.

The curved shapes of the two longer sides of the opening of the Wehnelt electrode can be determined so that the electron-beam-irradiation region can have a shape with almost no curvature or a linear shape as shown in FIG. 15B, the shape of the electron-beam-irradiation region being measured with the method shown in FIG. 16. Many openings with various curvature radii may be formed and tested with the method shown in FIG. 16 to determine the optimum pair of curvature radii. Alternatively, the inventors carried out not measurements for various curvature radii but theoretical calculations for the shapes of the electron-beam-irradiation region to determine the optimum pair of curvature radii, and thereafter the inventors actually made the opening with such optimum curvature radii and carried out the measurement shown in FIG. 16. The resultant values were above-described 150 mm in R1 and 64.7 mm in R2. It was confirmed that the calculated shape of the electron-beam-irradiation region was almost identical with the measured shape.

There will now be briefly explained a method of theoretical calculation. The finite element method is used to calculate an electric field in a space including the filament, the Wehnelt electrode and the target to further calculate a trajectory of a traveling electron which has been emitted from the filament, so that the shape of the electron-beam-irradiation region on the target can be obtained.

There will next be described calculation results for the curvature amount $\Delta W$ which is defined in FIG. 15A. The value of $\Delta W/W$ was 0.022 for the opening shown in FIG. 10, that is, with the linear longer sides. The value of $\Delta W/W$ was 0.0086 for the opening with 100 mm in R1 and 81.8 mm in R2, while $\Delta W/W$ was 0.0043 for the opening with 150 mm in R1 and 64.7 mm in R2.

Figure 12:
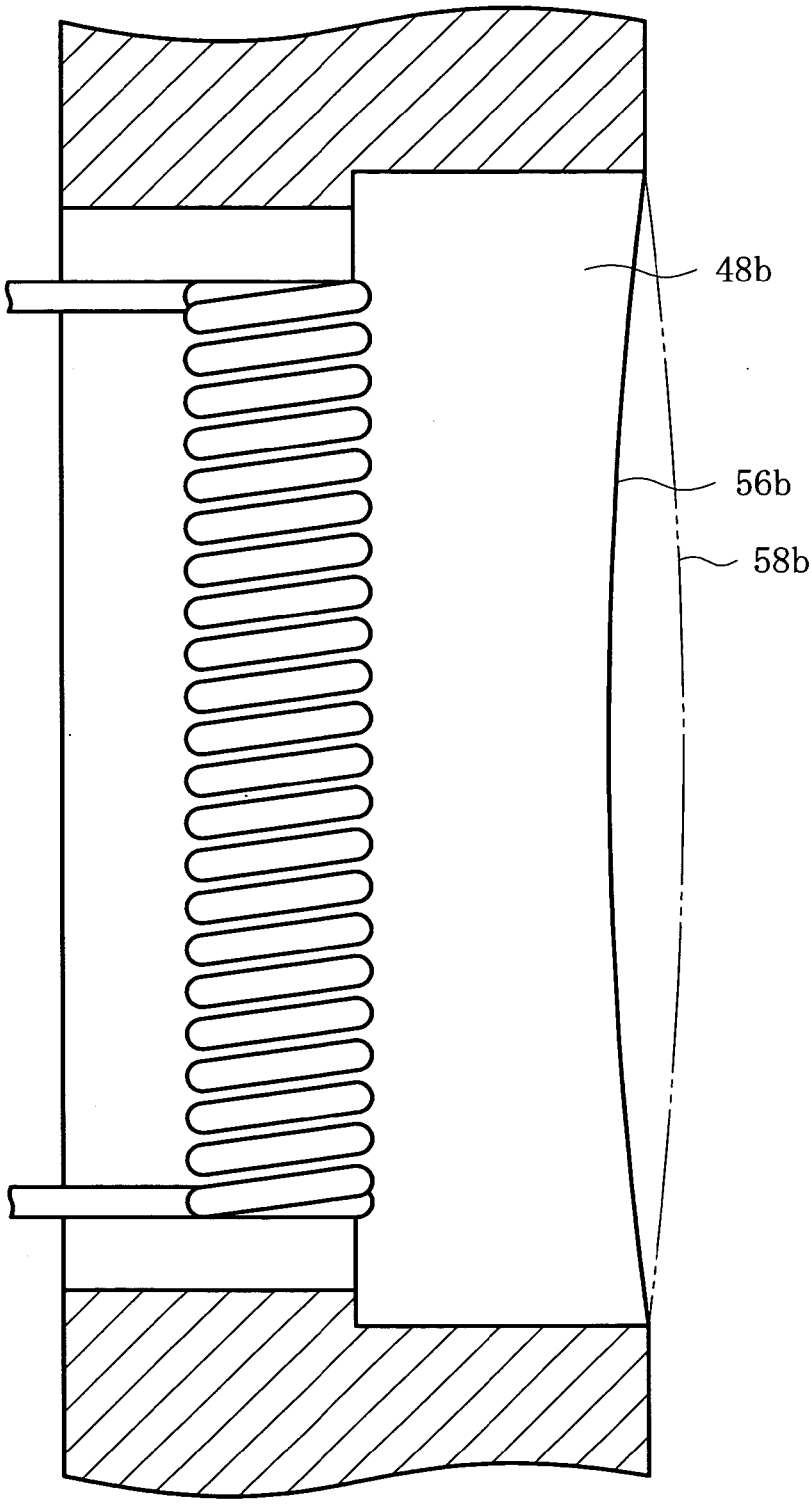
FIG. 12 is a sectional view showing an opening of the Wehnelt electrode in the second modification.

Next, the second modification of the opening of the Wehnelt electrode will be described. FIG. 12 is a sectional view showing an opening of the Wehnelt electrode in the second modification. The shape of the opening in the second modification as viewed from the front is identical with the shape shown in FIG. 10. The two longer sides of the opening, however, are curved in a direction perpendicular to the front face of the Wehnelt electrode. FIG. 12 is a sectional view taken along the line 12—12 in FIG. 10 for the second modification. One longer side 56*b* of the opening 48*b* is curved in a manner that the center of the longer side is retracted downward as viewed from the front (i.e., as viewed from the right in FIG. 12) while the other longer side 58*b* is curved in a manner that its center is projected upward as viewed from the front. In other words, the two longer sides 56*b* and 58*b* of the opening are curved in opposite directions relative to each other as viewed "in a direction which is parallel to the front face of the Wehnelt electrode and yet perpendicular to a longitudinal direction of the opening", i.e., in a direction perpendicular to the drawing sheet of FIG. 12. Also with such curved longer sides, there can be obtained the electron-beam-irradiation region having an almost straight shape as shown in FIG. 15B. The optimum curvature radii can be determined also in the second modification by conducting the procedures similar to that in the first modification shown in FIG. 11.

Figure 14:
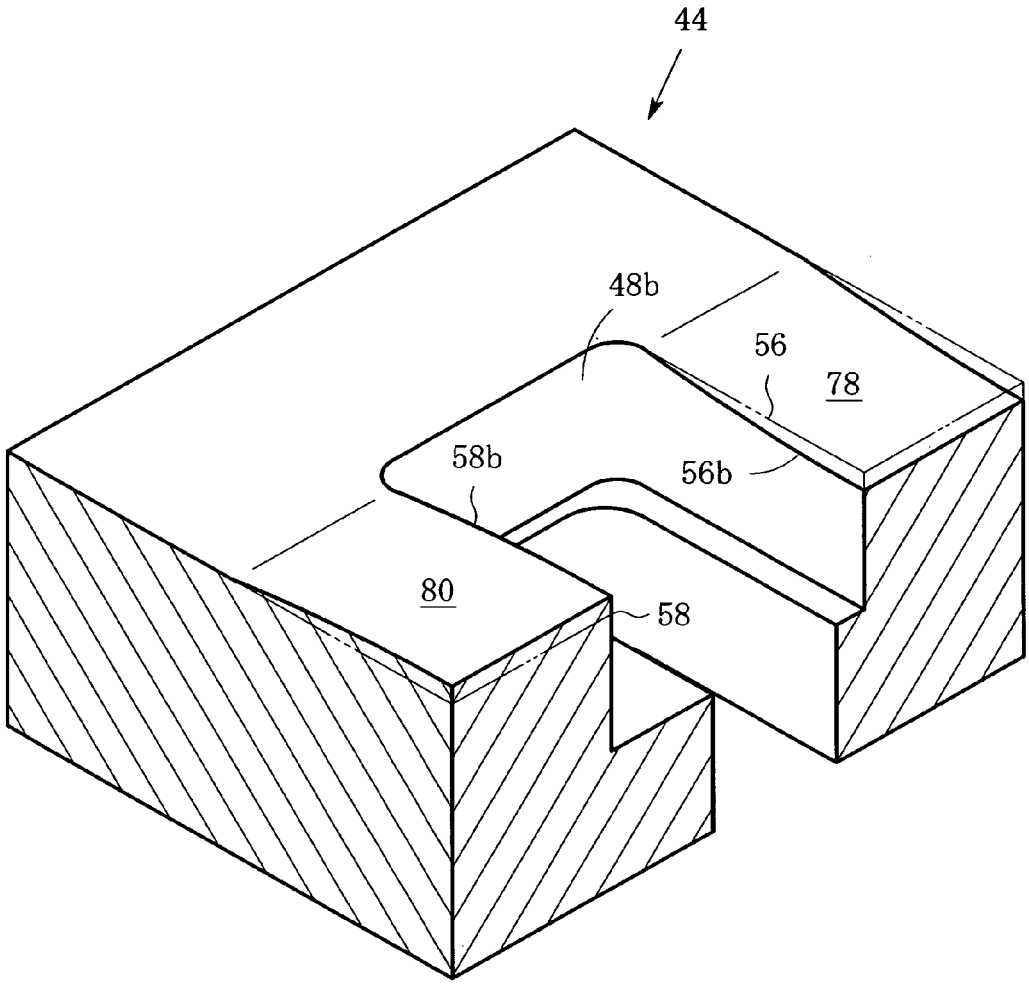
FIG. 14 is a perspective view, similar to FIG. 13, showing a part of the opening shown in FIG. 12.

FIG. 14 is a perspective view, similar to FIG. 13, showing a part of the opening of the second modification shown in FIG. 12. The front face of the Wehnelt electrode 44 in the second modification is not flat but curved. The front face part 78 of the wehnelt electrode 44 near one longer side 56*b* of the opening 48*b* is curved with a downward convex shape, while the front face part 80 of the wehnelt electrode 44 near the other longer side 58*b* is curved with an upward convex shape, noting that the conventional longer sides 56 and 58 are depicted by imaginary lines.

Figure 17:
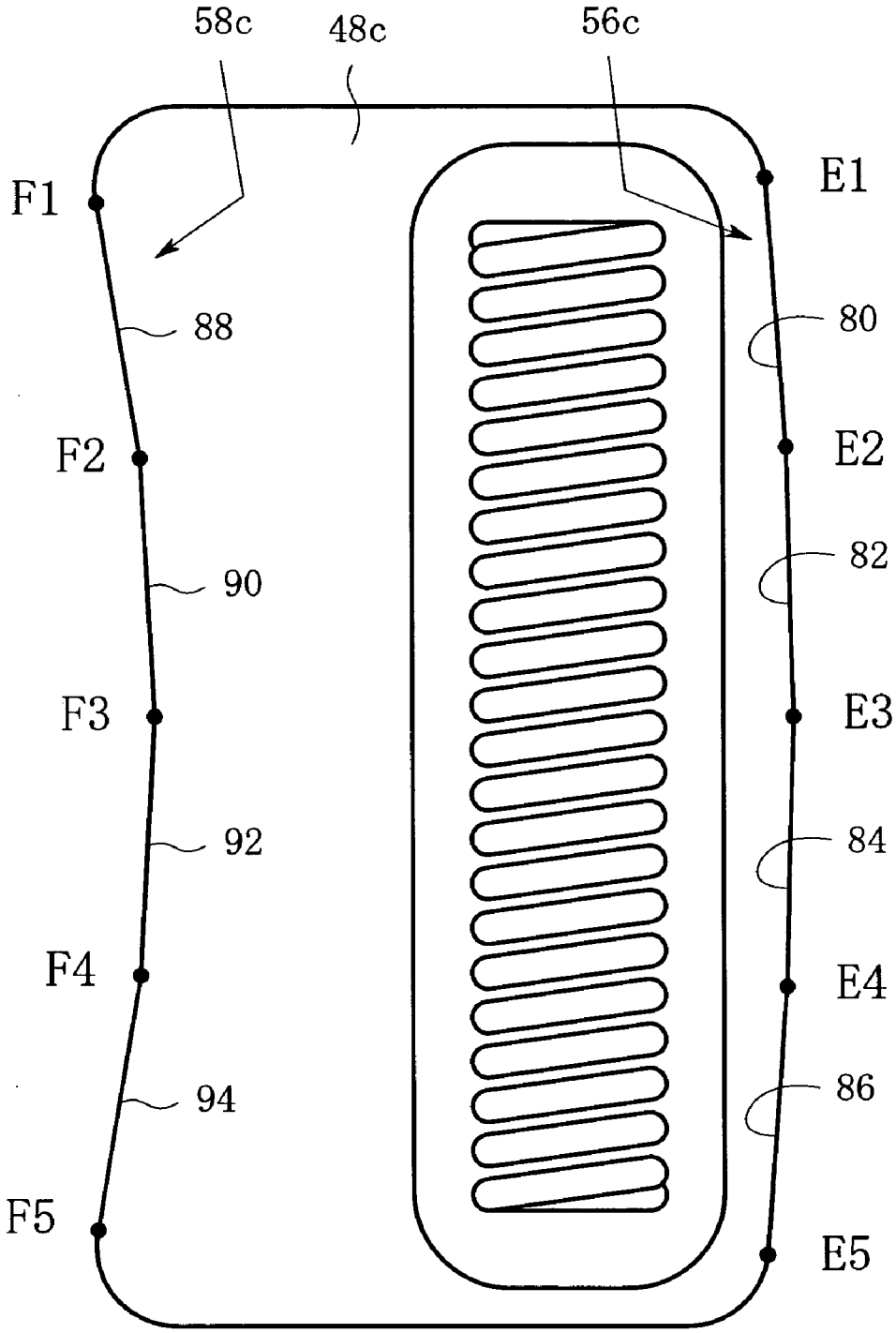
FIG. 17 shows the shape of an opening of the Wehnelt electrode in the third modification.

Next, the third modification of the opening of the Wehnelt electrode will be described. FIG. 17 shows the shape of an opening of the Wehnelt electrode in the third modification. One longer side 56*c* of the opening 48*c* has a shape consisting of a series of plural line segments approaching the circular-arc longer side 56*a* shown in FIG. 11. The longer side 56*a* shown in FIG. 11 has a shape consisting of a circular arc with a radius of 150 mm, while the longer side 56*c* shown in FIG. 17 has a shape consisting of a series of four line segments 80, 82, 84 and 86 approaching the circular arc, noting that the term "line segment" is defined as a finite part of a straight line. The circular arc is divided equally into four parts to get five boundary points (including two end points E1 and E5 and three division points E2, E3 and E4). The boundary points can be connected with one another by line segments to get four line segments 80, 82, 84 and 86. Similarly, the other longer side 58*c* has a shape consisting of a series of line segments approaching the circular-arc longer side 58*a* shown in FIG. 11, that is, a series of four line segments 88, 90, 92 and 94 approaches the circular arc with a radius of 64.7 mm. Even with the series of plural line segments approaching the circular arc, the electron-beam-irradiation region on the target would be hardly curved as with the circular arc. The number of line segments may preferably be any one of four to eight.

Figure 18:
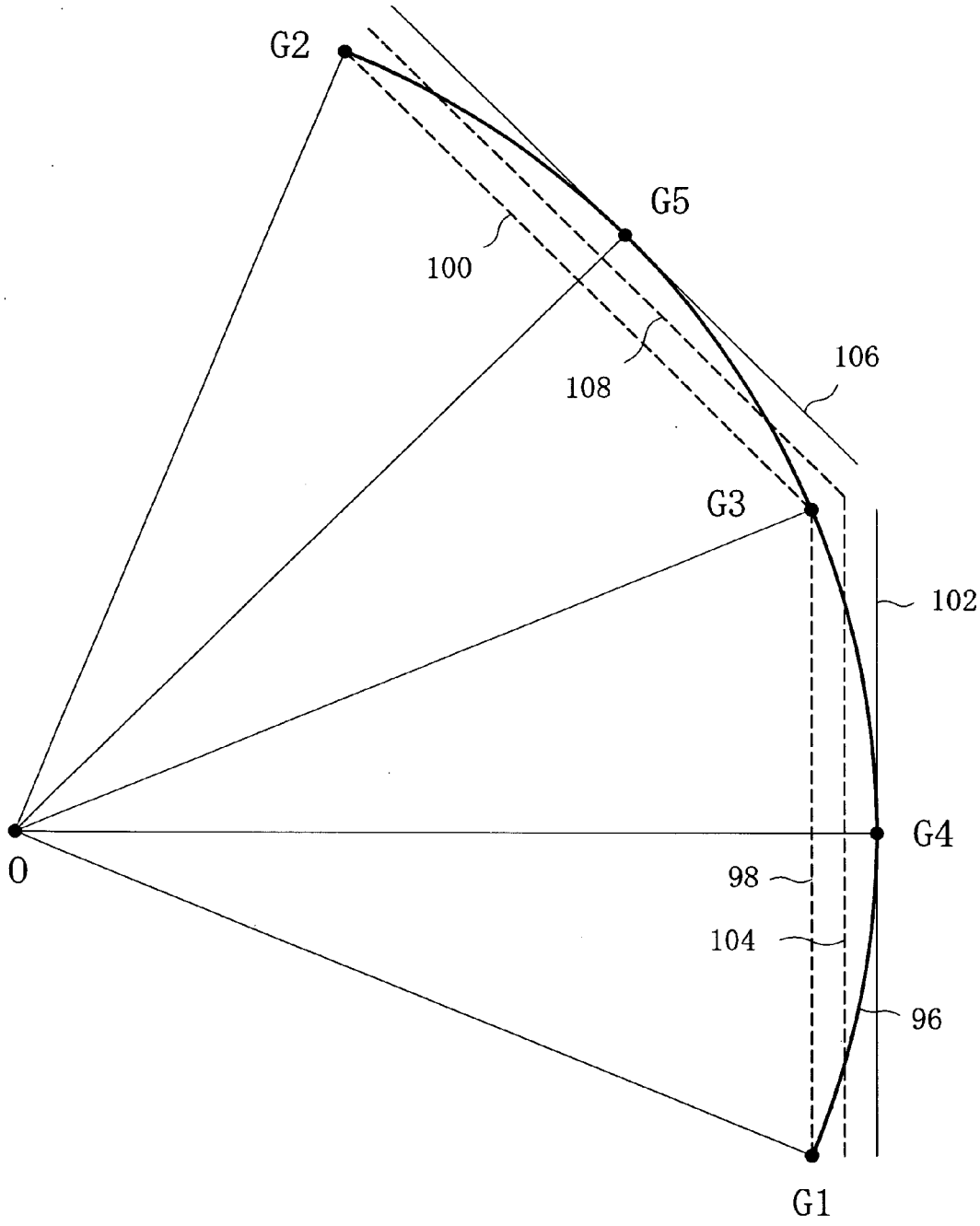
FIG. 18 is an illustration showing a method for making a series of plural line segments approaching a circular arc.

FIG. 18 is an illustration showing a method for making a series of plural line segments approaching a circular arc. There will now be explained, for example, that a circular arc 96 ranging between one end point G1 and the other end point G2 is divided equally into two line segments. The center of the circular arc 96 is the point O. First, the midpoint G3 is determined between the end points G1 and G2. Points G1 and G3 are connected to each other by a line segment 98 while points G3 and G2 are connected to each other by another line segment 100 to complete the simplest approaching method. Now, the circular arc G1–G2 has been approached by the two line segments 98 and 100, noting that the line segments 98 and 100 are positioned inside the circular arc 96. Alternatively, there may be used a more precise approaching method so that line segments can come closer to the circular arc as described below. The midpoint G4 is determined between points G1 and G3. A tangential line 102 to the circular arc 96 is drew at point G4. Another line segment 104 is drew at the midway between the tangential line 102 and the line segment 98 so as to be parallel to the tangential line 102. The resultant line segment 104 comes closer to the circular arc 96 than the line segment 98. Similarly, a similar tangential line 106 is drew at the midpoint G5 between points G3 and G2 and another midway line segment 108 is drew. Finally, the line segments 104 and 108 are connected to each other to approach the circular arc 96 by a series of the line segments 104 and 108 which is more precise than a series of the line segments 98 and 100. The two longer sides 56*c* and 58*c* of the opening shown in FIG. 17 each also may have a shape consisting of a series of such more precise line segments.

It should be noted that the present invention is not limited to the rotating anode X-ray tube but is applicable to the fixed target (i.e., stationary target) X-ray tube.

What is claimed is:

1. A coiled filament for an X-ray tube comprising:

a central region including plural turns having a same coil pitch; and end regions which are arranged on either side of the central regions and include plural turns each of which has a coil pitch smaller than the coil pitch of the central region, wherein the coil pitches of the plural turns of the end regions are reduced one by one by a same variation from a turn close to the central region toward an outermost turn, and $\Delta p/p$ is within a range of 0.015 to 0.1 and k/n is within a range of 0.3 to 0.8, where p is the coil pitch of the central region, $\Delta p$ is the coil pitch variation of the end regions, n is a total number of turns of the filament, and k is a sum of numbers of turns of the end regions.

2. A coiled filament for an X-ray tube according to claim 1, wherein the k/n satisfies the following equation:

$$k/n=0.72-4.66(\Delta p/p)\pm 0.12.$$

3. An X-ray tube comprising a coiled filament which includes:

a central region including plural turns having a same coil pitch; and end regions which are arranged on either side of the central regions and include plural turns each of which has a coil pitch smaller than the coil pitch of the central region, wherein the coil pitches of the plural turns of the end regions are reduced one by one by a same variation from a turn close to the central region toward an outermost turn, and $\Delta p/p$ is within a range of 0.015 to 0.1 and k/n is within a range of 0.3 to 0.8, where p is the coil pitch of the central region, $\Delta p$ is the coil pitch variation of the end regions, n is a total number of turns of the filament, and k is a sum of numbers of turns of the end regions.

4. An X-ray tube according to claim 3, wherein the k/n satisfies the following equation:

$$k/n=0.72-4.66(\Delta p/p)\pm 0.12.$$

5. An X-ray tube comprising:

an electron gun which includes a Wehnelt electrode formed with an elongate opening and a coiled filament disposed inside the opening to emit an electron beam; and a target which is irradiated with the electron beam to generate an X-ray beam, wherein the opening has two longer sides positioned asymmetrically about a center-of-width line of the filament, and the filament includes:

a central region including plural turns having a same coil pitch; and end regions which are arranged on either side of the central regions and include plural turns each of which has a coil pitch smaller than the coil pitch of the central region, the coil pitches of the plural turns of the end regions being reduced one by one by a same variation from a turn close to the central region toward an outermost turn.

6. An X-ray tube according to claim 5, wherein Δp/p is within a range of 0.015 to 0.1 and k/n is within a range of 0.3 to 0.8, where p is the coil pitch of the central region, Δp is the coil pitch variation of the end regions, n is a total number of turns of the filament, and k is a sum of numbers of turns of the end regions.

7. An X-ray tube according to claim 6, wherein the k/n satisfies the following equation:

$$k/n=0.72-4.66(\Delta p/p)\pm 0.12.$$

8. An X-ray tube according to claim 5, wherein each of the two longer sides is curved in a same direction as viewed in a direction normal to a front face of the Wehnelt electrode.

9. An X-ray tube according to claim 8, wherein each of the two longer sides has a shape consisting of a circular arc with a curvature radius which is different from a curvature radius of another longer side.

10. An X-ray tube according to claim 5, wherein the two longer sides are curved in opposite directions relative to each other as viewed in a direction which is parallel to a front face of the Wehnelt electrode and yet perpendicular to a longitudinal direction of the opening.

11. An X-ray tube according to claim 5, wherein an electron-beam-irradiation region on the target has an elongate shape, and the two longer sides of the opening are curved so that the electron-beam-irradiation region has a curvature coefficient being not greater than 0.01.

* * * * *